US007667599B2

(12) United States Patent
Mainini et al.

(10) Patent No.: US 7,667,599 B2
(45) Date of Patent: Feb. 23, 2010

(54) PIEZOELECTRIC CABLE-BASED MONITORING SYSTEM

(75) Inventors: Christopher E. Mainini, Knoxville, TN (US); Randal D. Boyd, Knoxville, TN (US)

(73) Assignee: Radio Systems Corporation, Knoxville, TN (US)

( * ) Notice: Subject to any disclaimer, the term of this patent is extended or adjusted under 35 U.S.C. 154(b) by 372 days.

(21) Appl. No.: 11/626,837

(22) Filed: Jan. 24, 2007

(65) Prior Publication Data

US 2007/0120667 A1 May 31, 2007

Related U.S. Application Data

(63) Continuation-in-part of application No. 11/214,522, filed on Aug. 30, 2005, now abandoned, which is a continuation-in-part of application No. 09/522,087, filed on Mar. 10, 2000, now Pat. No. 6,937,647.

(51) Int. Cl.
*G08B 13/00* (2006.01)

(52) U.S. Cl. ..... 340/565; 340/541; 340/540; 340/545.4; 340/573.1

(58) Field of Classification Search ..... 340/565, 340/686.1, 541, 540, 544, 545.4, 550, 693.5, 340/933, 573.1; 375/228
See application file for complete search history.

(56) References Cited

U.S. PATENT DOCUMENTS

| | | | | |
|---|---|---|---|---|
| 4,656,463 | A | 4/1987 | Anders et al. | |
| 5,432,498 | A * | 7/1995 | Zilbershtein et al. | 340/566 |
| 5,576,972 | A | 11/1996 | Harrison | |
| 5,589,817 | A * | 12/1996 | Furness | 340/467 |
| 5,808,562 | A * | 9/1998 | Bailleul et al. | 340/933 |
| 6,111,523 | A * | 8/2000 | Mee | 340/937 |
| 6,137,424 | A * | 10/2000 | Cohen et al. | 340/933 |
| 6,204,756 | B1 * | 3/2001 | Senyk et al. | 340/438 |
| 6,204,762 | B1 | 3/2001 | Dering et al. | |
| 6,937,647 | B1 | 8/2005 | Boyd et al. | |

* cited by examiner

*Primary Examiner*—Anh V La
(74) *Attorney, Agent, or Firm*—Pitts & Brittian, P.C.

(57) ABSTRACT

A system for monitoring and distinguishing occurrences along a perimeter bounded by a plurality of piezoelectric cables. The monitoring system utilizes a plurality of piezoelectric cables that generate electrical signals in response to mechanical stress events. The electrical signals from each piezoelectric cable are analyzed by a base unit to determine event classification and location. The monitoring system alerts users and connects to an existing security system to notify third-parties. The monitoring system includes functionality to communicate with a calibration unit and calibrate itself. The monitoring system also includes functionality to interface with a pet containment system.

33 Claims, 9 Drawing Sheets

PIEZOELECTRIC CABLE-BASED MONITORING SYSTEM

CROSS-REFERENCE TO RELATED APPLICATIONS

The present application is a continuation-in-part of application Ser. No. 11/214,522 filed Aug. 30, 2005, which is a continuation-in-part of application Ser. No. 09/522,087 filed Mar. 10, 2000, which issued as U.S. Pat. No. 6,937,647 on Aug. 30, 2005.

STATEMENT REGARDING FEDERALLY-SPONSORED RESEARCH OR DEVELOPMENT

Not Applicable

BACKGROUND OF THE INVENTION

1. Field of Invention

This invention pertains to a system for monitoring a selected zone. More particularly, this invention relates to a system for monitoring, optionally and distinguishing between, occurrences along one or more piezoelectric cables defining a monitored zone.

2. Description of the Related Art

Residential and light commercial security systems have become an increasingly popular addition to many homes and businesses. These systems are typically based on the electronic detection of a structure. These systems generally classify any input as an event, whether the input is a system message, a detected breach of a perimeter, a detected breach of an interior, or a failure of some part of the security system. The event is analyzed to determine a specific classification, more specifically whether there has been a breach or not. If an event is determined to be in the nature of a breach, it is further classified as being caused by environmental conditions, an animal, a human, or an automobile.

In a residential and light commercial security system a breach is generally detected at either the perimeter or the interior of the structure. The perimeter is typically the outer surface of the structure. The outer surface is almost always breached at the ingress/egress points to a structure such as doors and windows. Breaches at these ingress/egress points are generally detected by magnetic sensors that monitor the opening and closing of doors and windows and by frequency sensors attuned to the sound of glass breakage. Interior breaches are generally detected by heat and motion detectors that monitor moving objects having a temperature greater than the ambient temperature. While providing a warning of intrusion, both the detection of ingress/egress and interior breaches occur after the structure has been damaged or entry has been obtained.

In many security systems, motion sensors are used to turn on outdoor lighting, thereby providing a deterrent to intrusion onto the property. However, these sensors are indiscriminate in that they may be triggered by small animals, children, or other moving objects that are not considered security risks. Further, because of the difficulty in accurately setting the range and the imprecise detection zone of each sensor, setting up a comprehensive coverage area limited to the boundaries of one's property is difficult. Finally, it should be noted that while the external sensors can be connected to a central alarm system, the inability to discriminate between legitimate security risks and stray animals and the difficulty in defining the protection area render such a system unreliable.

BRIEF SUMMARY OF THE INVENTION

A monitoring system for detecting and providing notification of events using one or more piezoelectric cables is shown and described. The monitoring system utilizes a plurality of piezoelectric cables to define one or more zones. These zones often fully enclose a selected are but may need not fully bound the selected area to be effective. Each piezoelectric cable generates an electrical signal in response to a mechanical stress, such as a compression, pressure, torque, or stress.

At least one piezoelectric cable is arranged to define one or more zones so that any approaching object, such as a human, an animal, or a car that exerts a mechanical force on the ground proximate to a zone causes a response in one or more of the piezoelectric cables. Each piezoelectric cable communicates with a base unit that is responsive to the electrical signals produced by the piezoelectric cable(s) in response to the mechanical force, i.e., an intrusion event. In response to the intrusion event, the base unit communicates the event occurrence to a person or to an external system, such as a residential and light commercial security system. By using multiple piezoelectric cables, the monitoring system identifies the zone in which the intrusion event occurs. With additional processing, the monitoring system analyzes the magnitude and frequency of the resulting signal to classify the object that produced the intrusion event. This information is available through the notification process.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A piezoelectric cable-based monitoring system for detecting and indicating events occurring proximate to one or more piezoelectric cables that define one or more zones is shown and described. The piezoelectric cable-based monitoring system, or monitoring system, is generally referenced as 10*a* and 10*b* in description and the accompanying figures. The monitoring system optionally locates and classifies events occurring proximate to the piezoelectric cable(s). The present invention is also useful for alerting a pet owner when their pet leaves a containment area and for self-calibrating to adjust for changing conditions.

Figure 1:
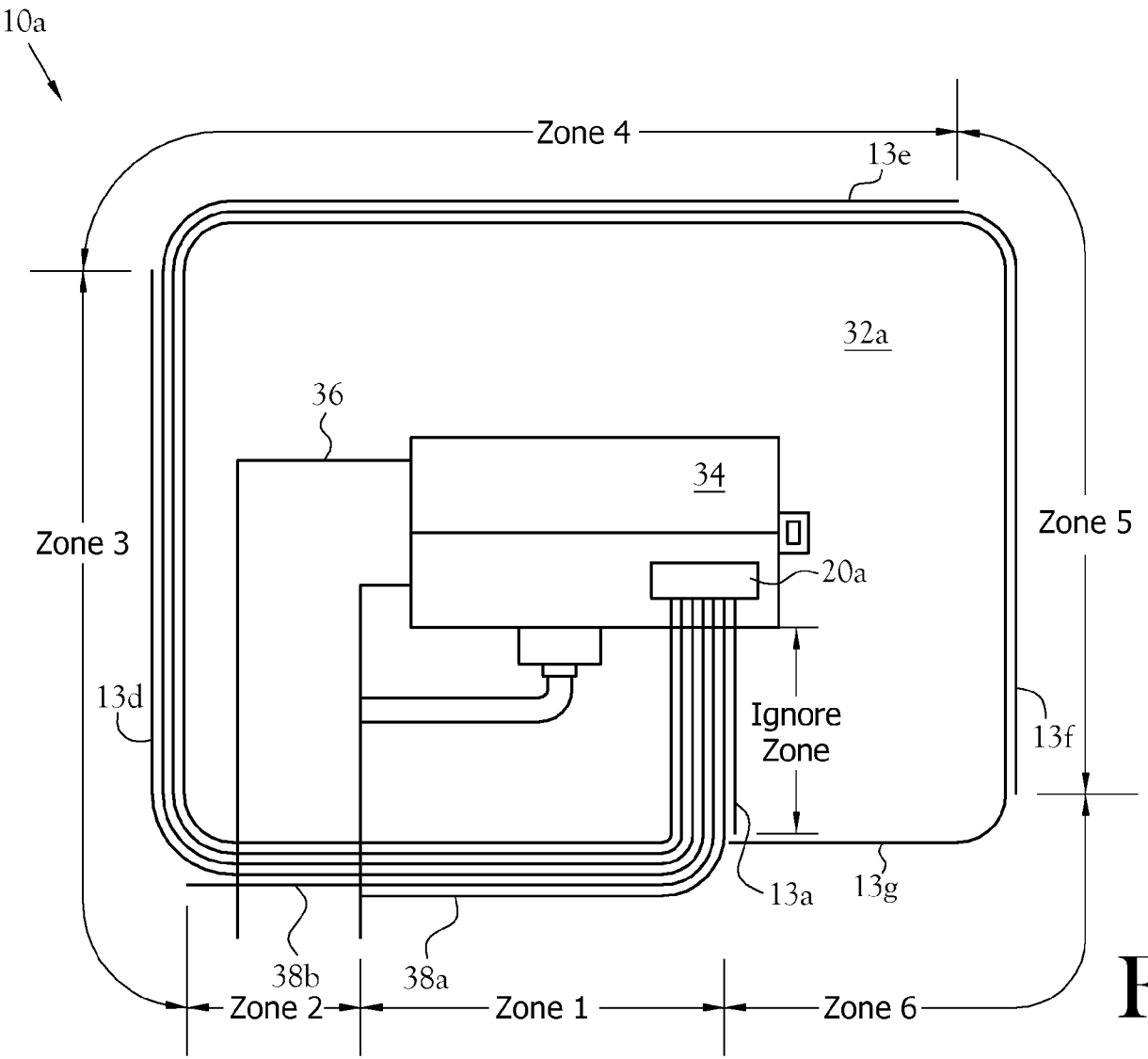
FIG. 1 illustrates the piezoelectric cable-based monitoring system showing one exemplary physical layout of the piezoelectric cables used with the present invention.

FIG. 1 illustrates one embodiment of the monitoring system 10 protecting a selected area 32, such as a residential lot. In the illustrated embodiment, the selected area 32 encompasses a residence 34 served by a driveway 36. The monitoring system 10*a* includes a base unit 20 and at least one piezoelectric cable, which is used to define one or more zones to be monitored. In the illustrated embodiment, six zones to be monitored are defined using seven piezoelectric cables 13*a-f*. The base unit 20*a* is typically located in an accessible location that provides protection from the elements, unauthorized access, and access to necessary utilities. One suitable location is inside the residence 34. It should be appreciated by one skilled in the art that this implementation of a monitoring system 10*a* is not limited to the monitoring of residential property. Examples of alternate uses of a piezoelectric cable-based monitoring system include monitoring the approach to a stationary objects, commercial buildings, open spaces of land or property, and other places or objects.

FIG. 1 also illustrates an exemplary physical layout of the piezoelectric cables 13*a-g* used with the monitoring system 10*a* of the present invention. In the illustrated embodiment, the selected area 32 is bounded by a plurality of contiguous piezoelectric cables 13*a-g* having varying lengths to produce a plurality of zones. Each of the piezoelectric cables 13*a-g* of the monitoring system 10*a* is in communication with the base unit 20*a*. The piezoelectric cables 13*a-g* generate an electrical signal when an event occurs proximate to the cables. The number of piezoelectric cables energized depends on the location of event. Where each of piezoelectric cables 13*a-f* terminates, a new zone is created until the final zone is represented by a single cable 13*g*. More specifically, each of the piezoelectric cables 13*a-g* is progressively longer. The distance between the respective distal ends of piezoelectric cables 13*b* and 13*c* define Zone 1. The distance between the respective distal ends of piezoelectric cables 13*c* and 13*d* define Zone 2, and so forth. Each zone is defined by a unique combination of one or more of the piezoelectric cables 13*a-g*.

Events occurring in the area from the base unit 20 to the desired location of Zone 1 would be detected because the piezoelectric cables 13*b-g* will respond to those events indiscriminately. To avoid this, an additional zone is created by the piezoelectric cable 13*a* that extends from the base unit 20*a* to the desired location of the Zone 1. When the additional piezoelectric cable 13*a* is active, the response from the remaining cables is ignored, thus providing an Ignore Zone within the bounded area 32. Any distinct zone that is created can be monitored or ignored.

Although the zones defined by the piezoelectric cables 13*a*-13*f* of the illustrated embodiment enclose the selected area 32, the zones need not form a perimeter. For instance, a plurality of zones defined by linear, parallel, and spaced apart piezoelectric cables allows distance to be gauged on a particular approach path but could be avoided altogether by a different approach path.

The number of piezoelectric cables used determines the number of location zones available. More specifically, the number of zones is controlled by the physical layout and number of the piezoelectric cables, which ultimately determines the number of unique combinations of piezoelectric cables servicing any particular area (zone). For the illustrated layout, the number of zones directly corresponds to the number of piezoelectric cables used.

Figure 2:
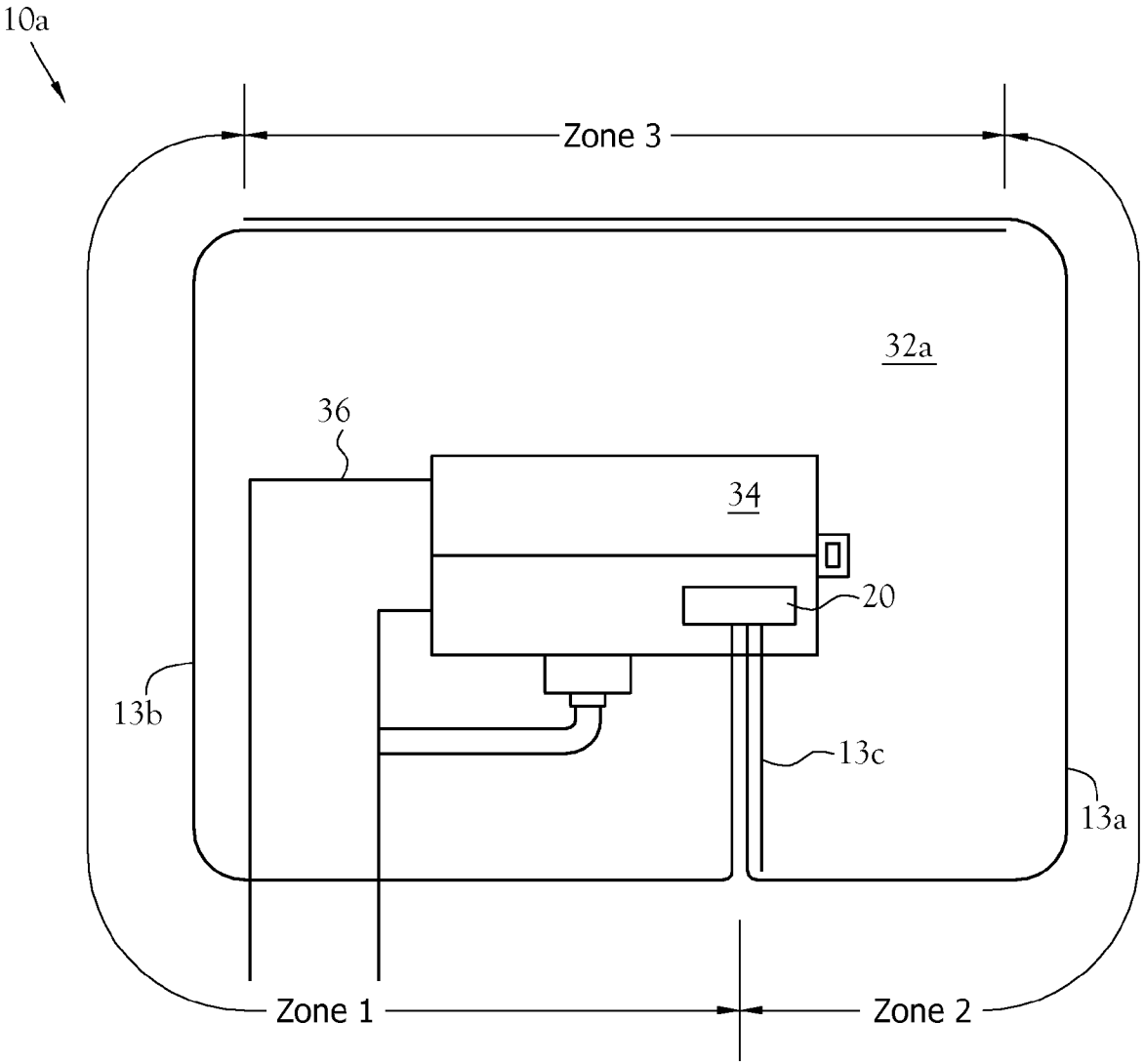
FIG. 2 illustrates an alternate physical layout of the piezoelectric cables used with the present invention.

FIG. 2 illustrates an alternate physical layout for the piezoelectric cables creating three zones using only two piezoelectric cables 13*a-b*. Each piezoelectric cable 13*a-b* is in communication with the base unit 20. A portion of the piezoelectric cables are do not overlap and define zones 1 and 2, respectively. A further portion proximate to the distal ends of each of the piezoelectric cables 13*a-b* overlap to define a third zone that can be identified when both piezoelectric cables 13*a-b* are activated. The area between the base unit 20 and the desired zones is ignored by adding piezoelectric cable 13*c*, as discussed above. In this layout, the number of zones does not correspond directly to the number of piezoelectric cables used.

Figure 3:
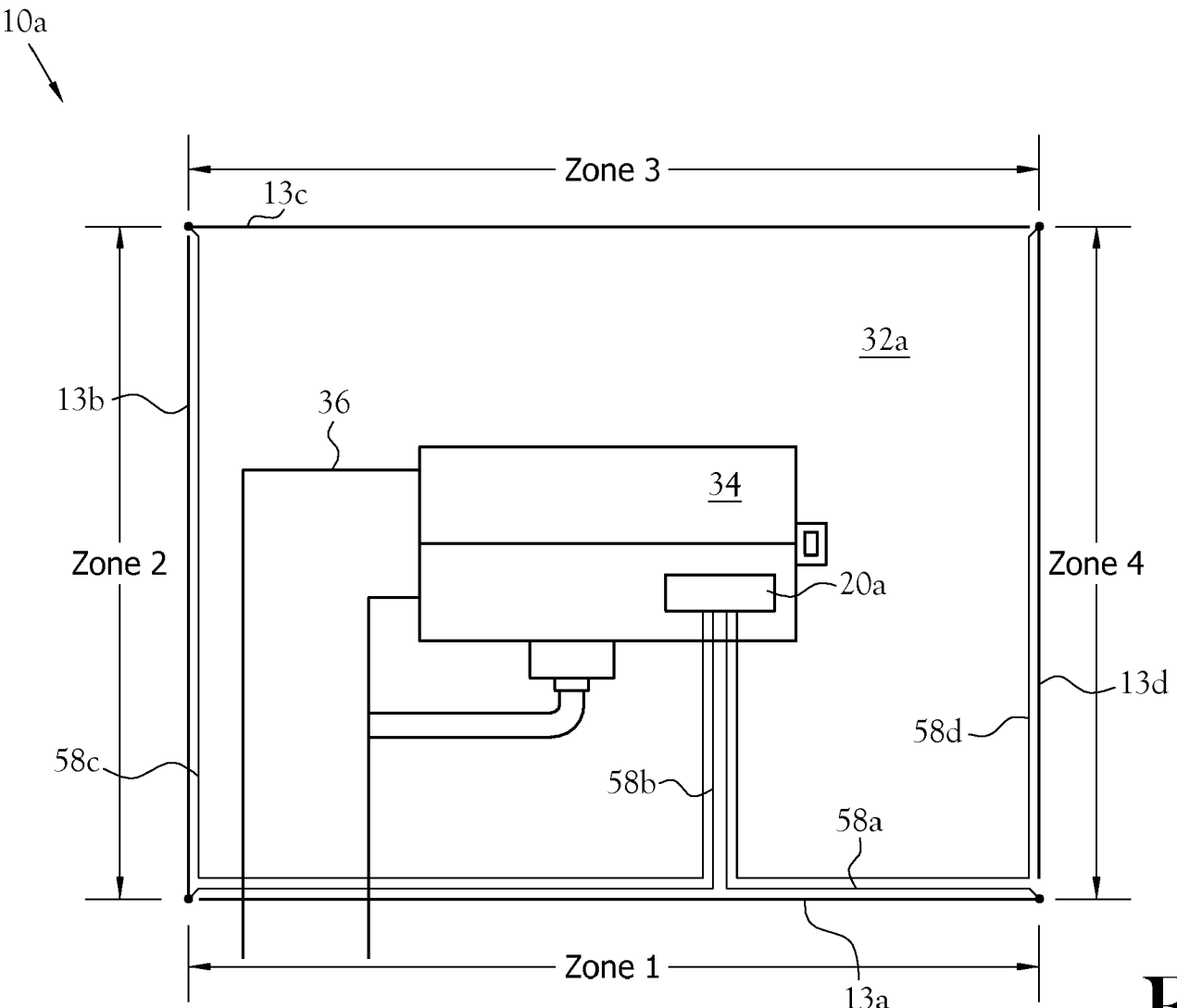
FIG. 3 illustrates another alternate physical layout of the piezoelectric cables used with the present invention.

FIG. 3 illustrates another alternate physical layout for the piezoelectric cables 13*a-d* creating four zones to be monitored. In this embodiment, the piezoelectric cables 13*a-d* are used only the desired zones. In areas where no monitoring is to occur, an electrically-conductive wire 58*a-d* that is not responsive to mechanical, referred to as a standard conductor, is used. Thus, to avoid the need for an ignore zone, the piezoelectric cables 13*a-d* located at the desired zones are connected to and communicate with the base unit 20 through the standard conductors 58*a-d*. There is substantially no overlap between the various piezoelectric cables 13*a-d* in this monitoring system, thus each piezoelectric cable uniquely defines a zone. Again, the number of zones directly corresponds to the number of piezoelectric cables used in this layout.

FIGS. 1-3 illustrate alternate physical layouts for the piezoelectric cables showing each cable individually and spaced apart to convey the detail of the present invention. One skilled in the art will appreciate that the actual installation will typically be in single channel with the cables likely in physical connection with each other.

Figure 4:
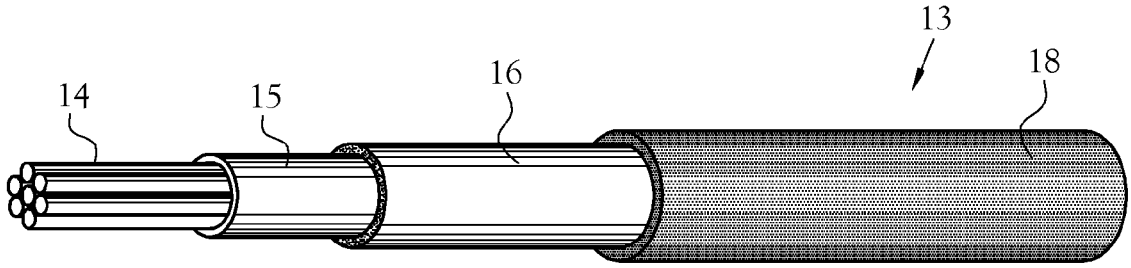
FIG. 4 illustrates a cut-away perspective view of a conventional piezoelectric cable used with the present invention.

FIG. 4 illustrates a cut-away view of a conventional piezoelectric cable 13 used with the present invention. One suitable cable is the KYNAR® PVDF Piezo Cable from Measurement Specialties, Inc. The piezoelectric cable 13 includes a stranded center core 14 surrounded by a piezoelectric film tape 15. The piezoelectric film tape 15 is covered by a shield 16, such as a copper braid or foil. A polyethylene outer jacket 18 encases the piezoelectric cable 13 to provide insulation from external electrical and environmental conditions. The piezoelectric film tape 15 generates charge in response to mechanical forces, such as stress or compression. The charge forms an electrical signal having an amplitude and frequency that is proportional to the mechanical force on the piezoelectric film tape 15 traveling in both directions of the piezoelectric cable 13. The piezoelectric cable 13 detects vibrations of about 0.001 Hz from impacts as small as those about 10-12 grams up to about 300,000 atmospheres. The electrical signals caused by mechanical forces are optionally analyzed to determine the classification of the event and/or where the event originated.

The working responsive range of a typical piezoelectric cable varies from direct contact (i.e., on the ground surface) to approximately three feet. Although piezoelectric cables may be sensitive to mechanical forces on the ground surface even at depths of up to three feet, the primary use for the present invention is to measure mechanical forces applied to the ground surface. Accordingly, the typical installation depth will be on the shallow end of the range, often only a few centimeters. The performance characteristics of the piezoelectric cable used, the soil composition, and the actual installation depth are factors affecting the sensitivity to mechanical forces of the piezoelectric cable. It should also be appreciated by one skilled in the art that shallower installation depths facilitate easier installation. While various installation depths are contemplated, the foregoing discussion is not intended to limit the disclosure to any particular depth.

Figure 5:
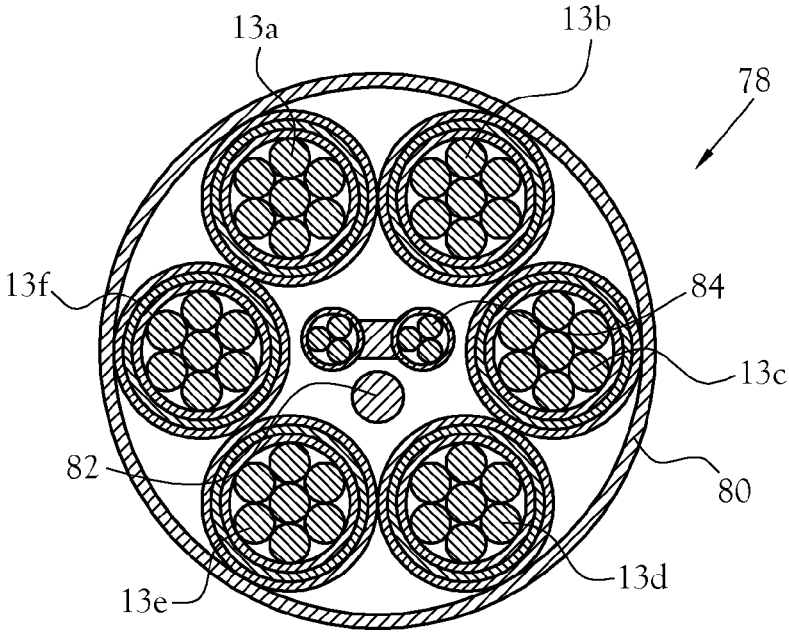
FIG. 5 illustrates a cross-section view of one embodiment of a composite cable adapted for use with the present invention.

FIG. 5 illustrates a cross-section view of a preferred embodiment of a composite cable 78 adapted for use with the present invention as a perimeter defining cable. The composite cable 78 includes a jacket 80 that generally services as conduit for at least one piezoelectric cable 13. As shown in FIG. 3, the jacket 80 houses a plurality of piezoelectric cables 13*a-g*, a non-insulated single conducting wire 82, and an insulated two-conductor cable 84. In various embodiments, the single conductor 82 is used to communicate with a calibration unit or as a broadcast or receiving antenna. The two-conductor cable 84 is generally used for providing power to remote equipment such as the calibration unit. These uses are representative of the various purposes to which either or both cables may be used. Those skilled in the art will recognize that type and number of cables and wires comprising the composite cable 78 can be varied according to the desired features of the monitoring system 10 without departing from the scope and spirit of the present invention. The general purpose of the composite cable 78 is to bundle the myriad cables used to implement the monitoring system 10. Use of a composite cable 78 ensures that the layout of the plurality of piezoelectric cables and any other wires is coordinated and generally facilitates efficient installation because of not having to deal with multiple loose cables.

Figure 6:
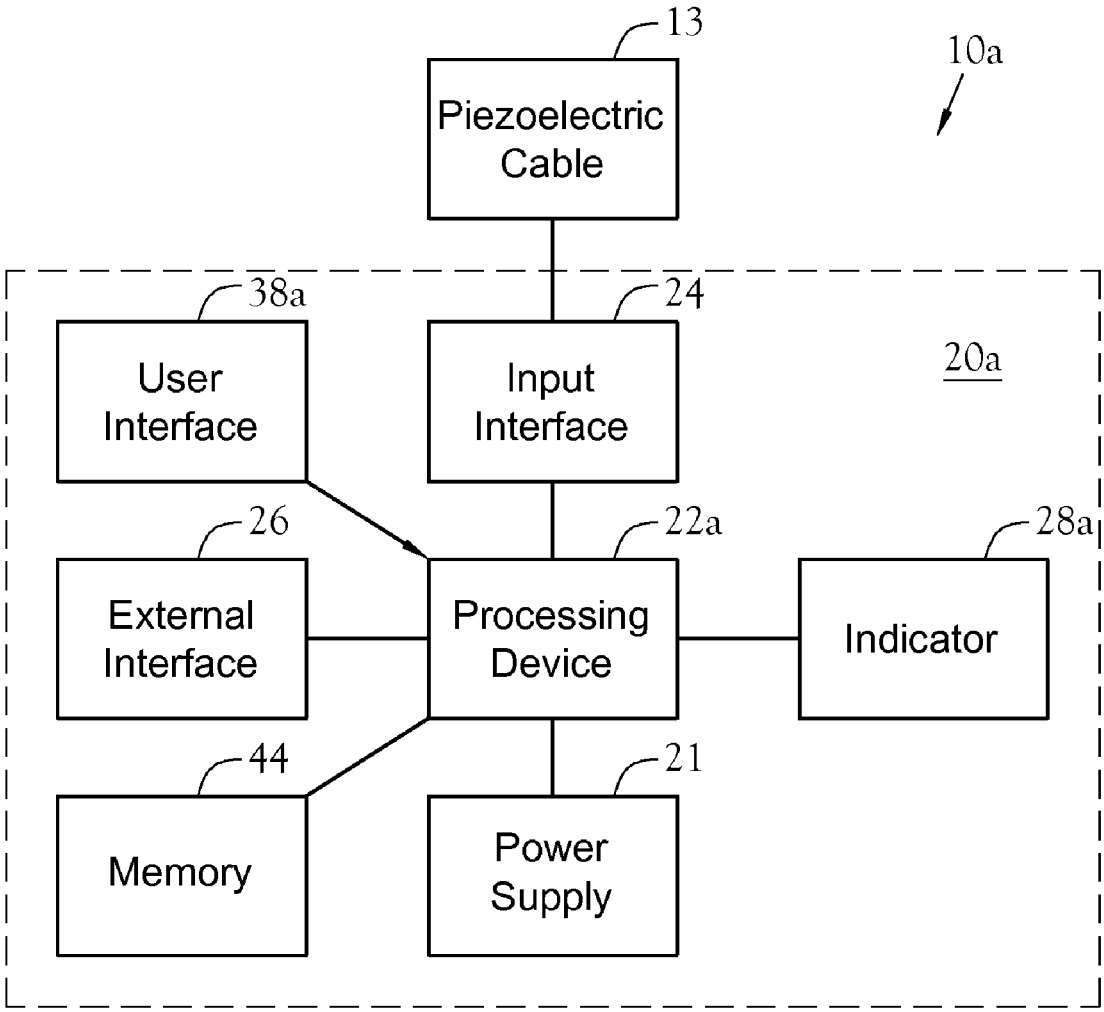
FIG. 6 illustrates a block diagram of one embodiment of the base unit used to sequence the present invention.

FIG. 6 illustrates a block diagram of one embodiment of the monitoring system 10*a*. The base unit 20*a* includes a processing device 22*a* that controls all general logic, control, and notification functions. A suitable processing device is any logic capable circuit or device capable of receiving an input, making a decision based on the input, and producing an output based on the result of the decision, such as, but not limited to, microprocessors, controllers, discrete logic circuits. The processing device 22*a* is in communication with the piezoelectric cables 13 to receive the electrical signals generated in response to mechanical forces. A power supply 21 receives, converts, conditions, varies the voltage and/or current, and supplies power necessary to operate the base unit 20*a*. A memory 44 in communication with the processor 22*a* allows for storage of event records and/or reference data against which the event signal can be compared. It will be appreciated by one skilled in the art that ore than one memory and both volatile and non-volatile memory can be used depending on the storage needs of the monitoring system 10*a*.

Upon receipt of the electrical signals, the processing device 22*a* determines at least that an intrusion event has occurred and activates an indicator 28 that provides notification of the intrusion. In one embodiment, the indicator 28 is a visual indicator that produces a visually observable signal when an intrusion event occurs. Examples of suitable visual indicators include flashing and/or colored lights providing information about the intrusion event or a display panel providing textual information about the intrusion event. In another embodiment, the indicator 28 is an audible indicator that produces a sound when an intrusion event occurs. In one embodiment, the indicator 28 provides a local notification that requires close proximity to the base unit 20, e.g., within line-of-sight or range-of-hearing. In another embodiment, the indicator is a remote device that can be located at distance from the base unit. The remote device communicates with the processor either through wired or wireless communications, such as an extended length of an electrical conductor or radio frequency communications. The various types of indications, both audible and visual, are usable with either of the local or remote indicators.

The processor 22*a* is also in communication with an external interface 26 that allows an external system to respond to intrusion events. In one embodiment, the external interface 26 is adapted to interface with a residential and light commercial security system allowing off-site monitoring of intrusion events to occur. In another embodiment, the external interface 26 is adapted to interface with existing objects to provide for notification. One such example is a switchable outlet that allows a table lamp to be turned off and on in response to an intrusion similar to telephone call notification systems used by the hearing-impaired. Another example of the external interface 26 is a telephone jack or network jack to allow the processor 22*a* to send a text message or e-mail to notify a user of an intrusion event. In a similar fashion, the external interface is a wired or wireless data interface to a personal computer (e.g., USB, Bluetooth®, serial, or parallel connections) that allows personal computer to contact the user by a telephone call, a text message, or an e-mail.

A user interface 38*a* in communication with the processor 22*a* to allow the user to set various parameters for the monitoring system 10*a*. The user interface 38*a* includes switches, dials, keypads, liquid crystal displays, light emitting diodes, and or other input/output devices to allow the user to communicate the parameters to the processor 22*a*. In one embodiment, the user interface allows the user to select the zone layout, whether a particular piezoelectric cable is active or not, whether a particular zone is active or inactive, what types of events warrant notification, whether events should be classified, monitoring schedules, and other settings corresponding to the operation of the monitoring system 10*a*.

In the illustrated embodiment, the base unit includes an input interface 24 that provides the necessary interface to make the electrical signals from the piezoelectric cable(s) 13 accessible to the processing device. Typically, the interface includes an analog-to-digital converter to convert the analog electrical signals into digital representations usable by the processing device 22*a*. The input interface 24 also includes impedance matching, amplification, and other signal conditioning as necessary and as will be appreciated by one skilled in the art. In an alternate embodiment, the input interface provides a binary interface that indicates which of the piezoelectric cables is active at any given moment.

The block diagram does not illustrate various connections, for example, power and ground connections to the various components; however, those skilled in the art will recognize the need for such wiring and understand how to connect such circuits, based on the components ultimately selected for use.

Figure 7:
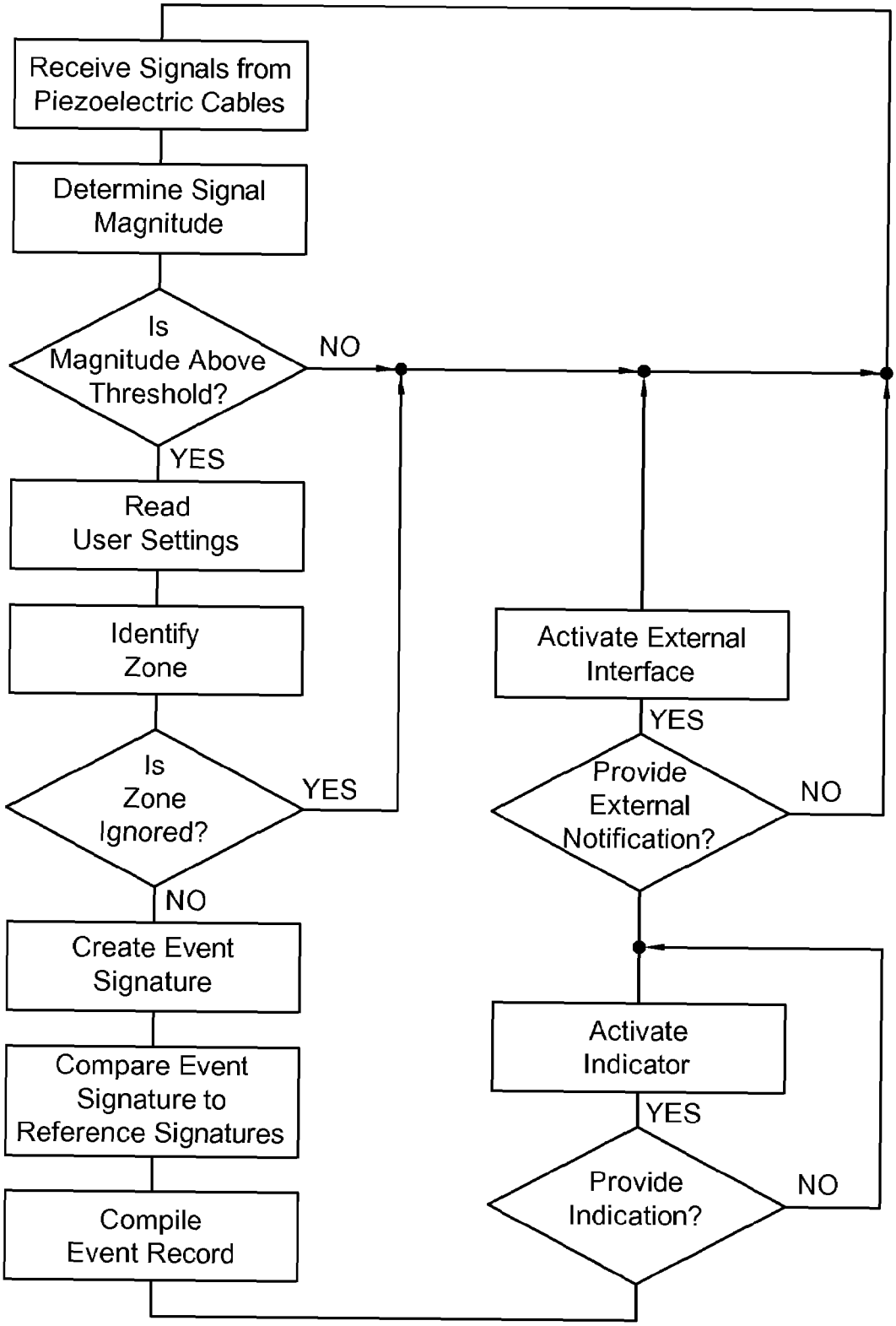
FIG. 7 is a flow chart of the process to determine event classification and location detection within the base unit of the present invention.

FIG. 7 is a flow diagram of one embodiment of a process for detecting, locating, and classifying an intrusion event and then providing notification to a user by the processing device 22*a* of the monitoring system 10*a* of the present invention. Initially, the processing device receives electrical signals from the piezoelectric cables generated in response to mechanical forces applied to the ground proximate the piezoelectric cables. A first evaluation determines if the magnitude of the electrical signal is sufficient to indicate that an intrusion event has occurred. This allows the processing device 22*a* to perform a first level of discrimination on the potential intrusion event. It is undesirable for the monitoring system to issue alerts for any mechanical force occurring proximate to the piezoelectric cable. For example, a heavy rain or acorns falling could generate an electrical signal but should not trigger notification of an intrusion event. If the magnitude is above a threshold level, further analysis of the electrical signal begins.

The next stage of analysis provides an event location function. The stage begins with reading the user settings for the monitoring system 10*a*. The user settings are read either directly from the user interface or from settings stored in memory that have been adjusted through the user interface. The user settings allow the user to select whether a particular piezoelectric cable is active or not, whether a particular zone is active or inactive, what types of events warrant notification, whether events should be classified, monitoring schedules, and other settings corresponding to the operation of the monitoring system 10*a*.

A simple user interface allows the selection of one of a limited number of predetermined piezoelectric cable layouts to establish the zones. A more sophisticated user interface allows any piezoelectric cable layout to be specified by the user. Once the piezoelectric cable layout has been configured, the zones are either established manually by the user or automatically by the processing device 22*a*. Each distinct zone is then configured to be monitored or ignored.

Before proceeding, the first check is to determine in which zone the intrusion event occurred. In general, location is established by evaluating which combination of piezoelectric cables detected the mechanical force and produced a response. Thus, for in the example of FIG. 2, if only one of the piezoelectric cables 13*a-b* detects mechanical forces, the intrusion event is determined to occur in the zone corresponding to the reporting cable. If both piezoelectric cables detect the same mechanical force, the intrusion event is determined to have occurred in the zone corresponding to the area of overlap of the two piezoelectric cables.

Once the zone in which the intrusion event occurred has been determined, the processing device determines whether a zone is being monitored or ignored. If the zone is being ignored, no further processing of the electrical signal is necessary. If the zone is being monitored, a signature is created. The signature is a set of identifying characteristics from the electrical signal that are used to infer information about the object producing the mechanical force. A simple signature involves only the magnitude of an electrical signal either taken in isolation or averaged over time. A more complex signature contains peak information collected over a period of time. The signature is compared to a set of reference signatures available to the processing device. If the signature cannot be matched to any of the reference signatures to a reasonable degree of certainty, the intrusion event is unclassifiable and the notification stage commences. If the signature matches one of the reference signatures, the type of intruder can be classified. The basic classifications used are quadrapeds, bipeds, and vehicles. One skilled in the art will appreciate that other classifications are available based on the algorithms used.

After analysis, the intrusion event record is compiled and stored. A basic intrusion event record includes the date and/or time that the intrusion event occurred. In other embodiments, the intrusion event record includes zone (location) information and/or classification information. The information in the intrusion event record is stored in temporary or permanent storage depending upon the objectives and capabilities of the monitoring system 10*a*. The information in the intrusion event record is communicated to the user through the indicator of the monitoring system or to an external device through the external interface.

Optionally, the intrusion event record is tested to determine whether specific notification criteria are met and selectively transmit information to appropriate devices. Not all information need be transferred to all devices. In one embodiment, the processing device 22*a* selectively communicates intrusion event records to a monitored security system via the external interface. For example, it is desirable to not report animal intrusions to the monitored security system to avoid a police response for every stray animal that wanders through a monitored zone. The ability to ignore or provide notifications at certain times or on certain days is useful. One might choose to ignore vehicles passing through the driveway zone (Zone 2 in FIG. 1) but would desire notification if a vehicle entered the yard through a different zone (Zones 1 and 3-6). Other decision criteria are limited only by the design choices in the implementation of the monitoring system 10*a*.

Once processing is completed either by virtue of the intrusion event being below a certain threshold, being in an ignored zone, or being the subject of a notification, the process repeats.

Figure 8:
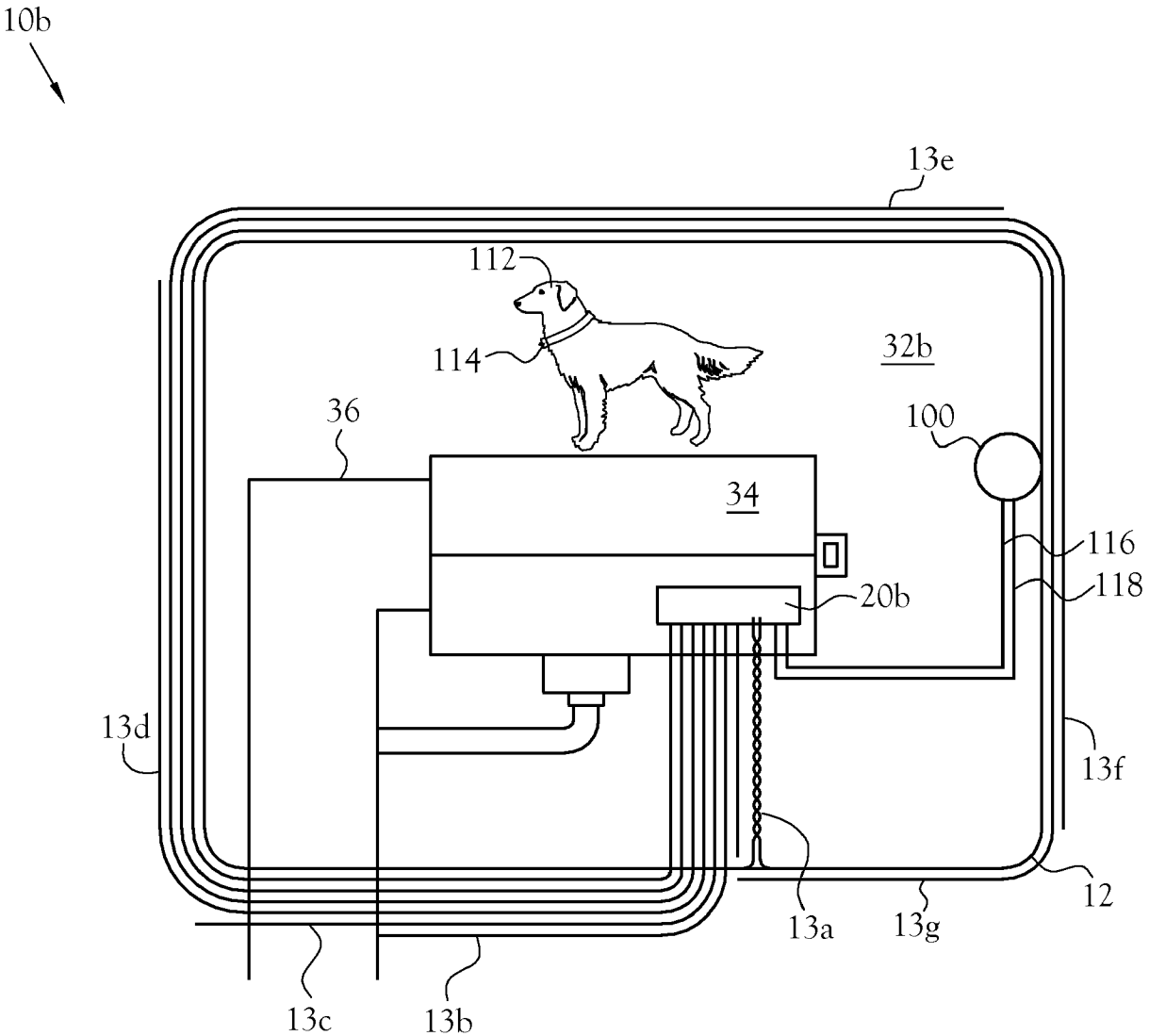
FIG. 8 illustrates one embodiment of the present invention for performing intrusion detection, pet containment, and calibration functions

FIG. 8 illustrates a combination monitoring and pet containment system 10*b* according to the present invention. The combination monitoring and pet containment system 10*b* includes a plurality of piezoelectric cables 13*a-g* connected to a base unit/transmitter 20*b*. In the illustrated embodiment, the physical layout of the plurality of piezoelectric cables from FIG. 4 is shown. In addition to the piezoelectric cables 13*a-g*, a wire-loop 12 is connected to the base unit/transmitter 20*b*. The wire-loop 12 bounds a containment area 32*b* in which the owner desires a pet 112 to remain. The pet 112 carries a correction unit 114 of a type known to one of ordinary skill in the art. The correction unit 114 is responsive to a containment signal generated by the base unit/transmitter 20*b* and broadcast on the wire-loop 12. Various structures, techniques, and encoding methods for generation and transmission of the correction signal are also familiar to those skilled in the art. As the pet 112 approaches wire-loop 12, a warning and/or correction stimulus is administered to the pet 112. The warning and/or correction stimulus is intended to deter the pet 112 from leaving the containment area 32*b*.

Incidentally, the containment area 32*b* conforms to the zones defined by the piezoelectric cables 13*a-f* in the illustrated embodiment, but it is not required that the two area match.

Figure 9:
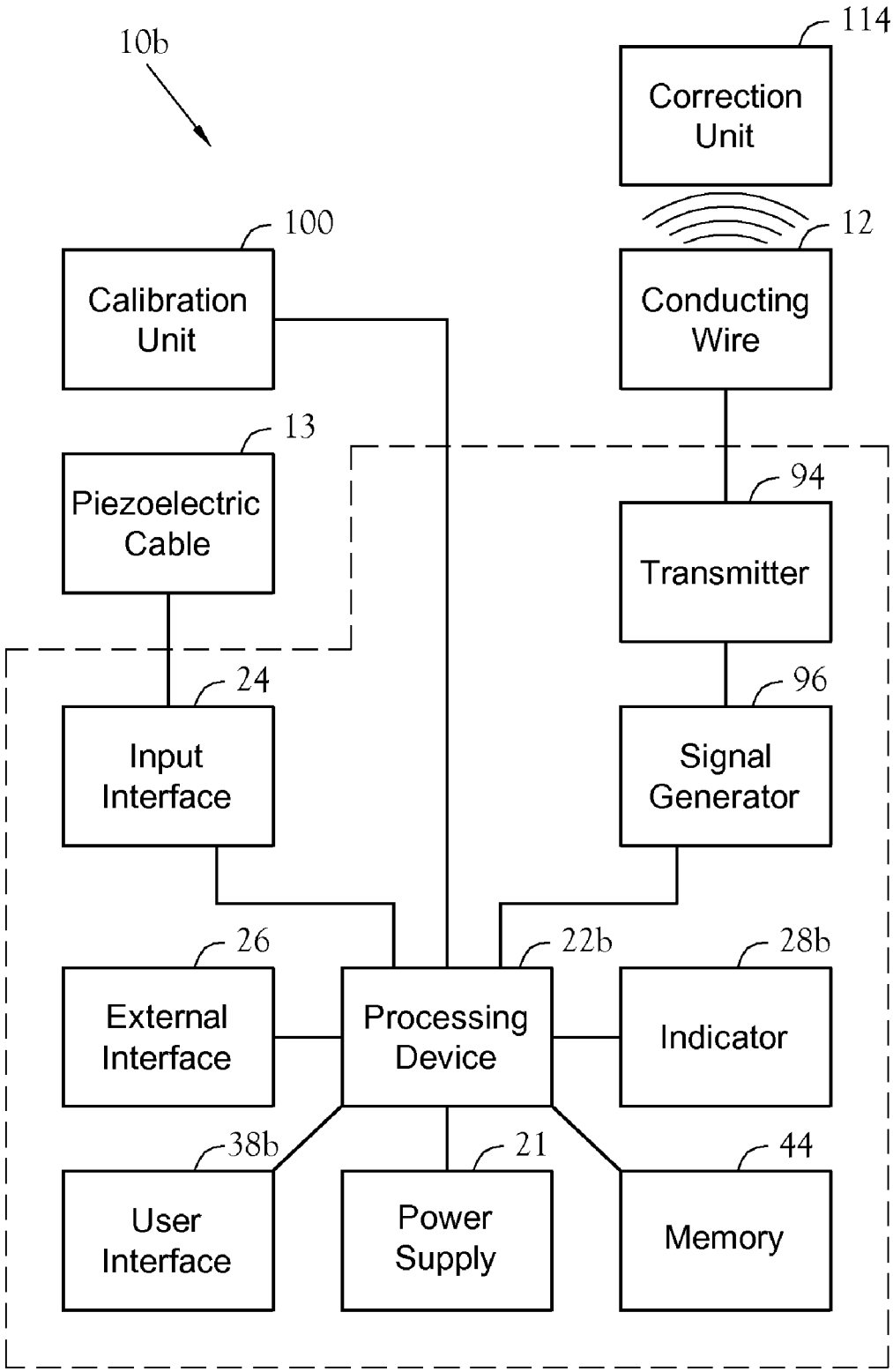
FIG. 9 illustrates a block diagram of one embodiment of the monitoring system combined with pet containment functions.

FIG. 9 is a block diagram of one embodiment of a monitoring system with added pet containment and calibration functions 10*b*. In addition to the structures discussed in relation to FIG. 6, the combination monitoring system 10*b* includes a containment signal generator 96 feeding a transmitter 94. The wire-loop 12 bounding the containment area 32*b* is connected to the transmitter 94. The calibration unit 100 is in communication with the processing device 22*b*. Because of the addition of the pet containment functions, the user interface 38*b* is generally expanded to include controls for adjusting the containment signal strength and whether warning and/or correction components are generated. In one embodiment, the user interface 38*b* also includes controls for setting calibration parameters, such as frequency of calibration. Similarly, the indicator 28*b* is generally expanded to accommodate increased notifications due to the addition of pet containment and calibration functions. For example, one embodiment of the indicator 28*b* provides success/failure notification for the calibration function and wire-loop continuity status for the pet containment function. The types of controls in the user interface and the indications available through the indicators are selected based on design considerations and implemented features.

Soil conditions vary with the prevailing environmental conditions, especially variables such as rainfall, humidity, and temperature. As soil conditions change, the response of the piezoelectric film to any particular mechanical force will vary. The embodiment of the piezoelectric security system

10*b* shown in FIG. 8 is capable of self-calibration to account for changing soil conditions. At least one calibration unit 100 is deployed around the proximate to one or more of the piezoelectric cables 13*a-f*. The calibration unit 100 receives control signals from the base unit 20*b* via a conductor 116. In one embodiment, power is supplied to the calibration unit 100 from the base unit 20*b* via a separate conductor 118. For example, using the composite cable of FIG. 5, the single wire conductor 82 is used for communication and the two-wire conductor 84 supplies power to the calibration unit 100. Alternatively, the calibration unit 100 includes an independent power source, such as a battery, solar cell, or direct alternating current (AC) connection.

Figure 10:
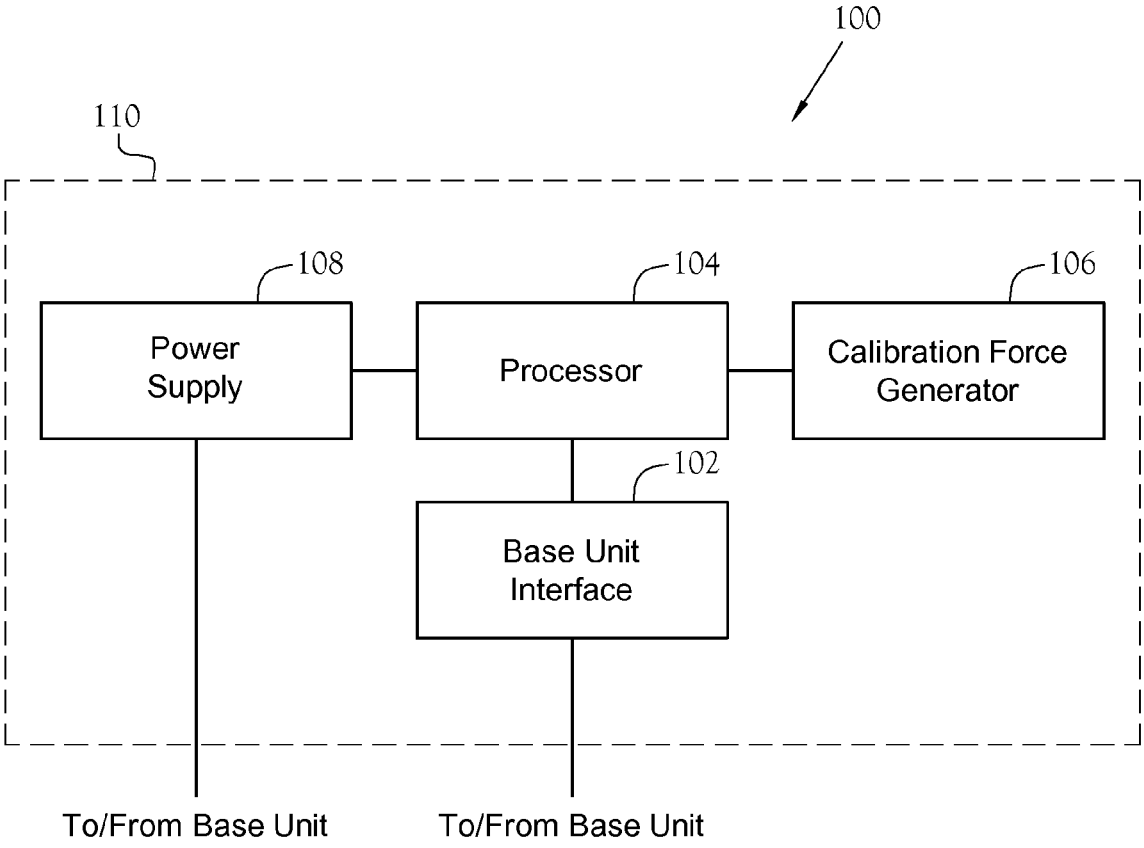
FIG. 10 illustrates a block diagram of one embodiment of a calibration unit for use with the present invention.

FIG. 10 illustrates a block diagram of one embodiment of the calibration unit 100. The calibration unit 100 includes a controller interface 102 that facilitates between a processor 104 in the calibration unit 100 and the base unit 20*b*. When the calibration unit 100 is activated, the processor 104 drives a calibration force generator 106 to produce a calibration force of known magnitude and frequency. Examples of suitable calibration force generators include solenoids, motors driving an eccentric weight or piston to create vibrations or impacts, and acoustic wave generators. In the illustrated embodiment, the calibration unit 100 is in communication with the base unit 20*b*. Because the base unit 20*b* is in communication with the calibration unit 100, the parameters of the calibration force being generated can be adjusted until satisfactory calibration results are obtained by the base unit. For example, the base unit 20*b* can request that the frequency, magnitude, repetition rate, or other parameter be varied until the calibration signals are detectable.

The calibration force is detected by the piezoelectric cables 13*a-f* and received at the base unit 20*b* as calibration signals. Once received at the base unit 20*b*, the calibration signals are compared to expected results stored in the base unit memory 44 and adjustments to the monitoring profiles are made based on the differences between the calibration signals and the expected results. This allows the monitoring system to remain reasonably accurate despite changing environmental conditions. The components of the calibration unit 100 are contained within a housing 110 that is environmentally appropriate, i.e., a housing that can withstand moisture, temperature differentials, and moderate physical abuse.

A simpler embodiment of the calibration unit includes only a housing 110 containing the force generator 106 connected to a power supply 108. Activation of the mechanical force generator 106 is accomplished simply by supplying power to the power supply 108. This simplified embodiment requires the base unit 20*b* to determine when power should be supplied and does not receive instructions from the base unit 20*b*. The simplified calibration unit, generally, has a limited range of preset calibration forces that it can generate.

A piezoelectric cable-based monitoring system has been shown and described. The piezoelectric cable-based monitoring system uses one or more cables to define a plurality of zones. A unique combination of cables defines each zone. By monitoring activity on the piezoelectric cables, an intrusion event is detected. By determining which of the piezoelectric cables have activity, the unique combination and, therefore, the zone where the intrusion event occurred is determined. The piezoelectric cable-based monitoring system is optionally integrated with a pet containment system to provide both pet containment and premise monitoring functions. The piezoelectric cable-based monitoring system also includes an optional calibration unit that allows the system to adapt to changing environmental conditions.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of the general inventive concept.

Having thus described the aforementioned invention, what is claimed is:

1. A piezoelectric security system for monitoring a selected area, said piezoelectric security system comprising:

a plurality of piezoelectric cables positioned along the selected area, said plurality of piezoelectric cables defining a plurality of unique combinations, each of said plurality of unique combinations defining a zone, each of said plurality of piezoelectric cables producing an electrical signal in response to a mechanical force;

a processor in communication with said plurality of piezoelectric cables, said processor responsive to each said electrical signal produced by said plurality of piezoelectric cables, said processor detecting an intrusion event when at least one electrical signal is received, said processor identifying said zone based on receipt of a plurality of electric signals corresponding to one of said plurality of unique combinations of piezoelectric cables, said processor producing an alert signal in response to said intrusion event, said alert signal containing information including at least said zone; and a communication device for communicating said alert signal.

2. The piezoelectric security system of claim 1 wherein each of said plurality of piezoelectric cables has a portion not contiguous with at least one other of said plurality of piezoelectric cables.

3. The piezoelectric security system of claim 1 wherein said communication device is an indicator providing an indication selected from the group consisting of audible indications and visual indications.

4. The piezoelectric security system of claim 1 wherein said communication device is an external interface for communicating said alert signal to an external device.

5. The piezoelectric security system of claim 1 further comprising a calibration unit positioned proximate to said plurality of piezoelectric cables, said calibration unit responsive a calibration request from said processor, said calibration unit generating a mechanical force detectable by said plurality of piezoelectric cables as a calibration signal, said calibration signal being compared to a set of expected results thereby allowing said processor to detect intrusion events.

6. The piezoelectric security system of claim 1 further comprising a piezoelectric cable interface connected to said plurality of piezoelectric cables and in communication with said processor, said processor receiving said electrical signals through piezoelectric cable interface, said piezoelectric cable interface making said electrical signals usable by said processor.

7. The piezoelectric security system of claim 1 wherein said communication device is a transmitter for broadcasting said alert signal, said piezoelectric security system further comprising:

a receiver in communication with said transmitter, said receiver receiving said alert signal; and an indicator in communication with said receiver, said indicator providing an indication selected from the group consisting of audible indications and visual indications.

8. The piezoelectric security system of claim 1 further comprising:

a wire-loop defining a boundary around a containment area including at least a portion of the selected area;

a containment signal generator in electrical communication with said wire-loop, said containment signal generator producing a containment signal carried by said wire-loop;

a receiver carried by an animal, said receiver responsive to said containment signal;

a processing device in communication with said receiver, said processing device producing a stimulus signal when said containment signal is received; and a stimulus delivery mechanism in communication with said processing device, said stimulus delivery mechanism applying a stimulus to the animal upon receipt of said stimulus signal.

9. The piezoelectric security system of claim 1 wherein said alert signal contains information corresponding to one or more of a time of said intrusion event and a date of said intrusion event.

10. The piezoelectric security system of claim 1 further comprising a memory device in communication with said processor, said memory device storing reference information for comparison with said electrical signal whereby said intrusion event is classified as being generated by a vehicle, a human being, or an animal.

11. The piezoelectric security system of claim 1 further comprising a memory device in communication with said processor, said memory device storing information about each said intrusion event for later recall.

12. A piezoelectric security system for monitoring a selected area, said piezoelectric security system comprising:

a plurality of piezoelectric cables positioned along the selected area, each of said plurality of piezoelectric cables having a portion overlapping at least a portion of at least one other of said plurality of piezoelectric cables, each of said plurality of piezoelectric cables having at least a portion that does not overlap any portion of any other said plurality of piezoelectric cables, each of said plurality of piezoelectric cables producing an electrical signal in response to a mechanical force;

a processor in communication with said plurality of piezoelectric cables, said processor responsive to at least a first electrical signal and a second electrical signal, said processor detecting an intrusion event when at least one of said first electrical signal and said second electrical signal is received, said processor identifying an intrusion zone based which of said first electrical signal and said second electrical signal are received, said processor producing an alert signal in response to said intrusion event, said alert signal containing information including at least said intrusion zone; and a communication device for communicating said alert signal.

13. The piezoelectric security system of claim 12 wherein each of said plurality of piezoelectric cables is a different length from each other of said plurality of piezoelectric cables.

14. The piezoelectric security system of claim 12 further comprising a piezoelectric cable interface connected to said plurality of piezoelectric cables and in communication with said processor, said processor receiving said electrical signals through piezoelectric cable interface, said piezoelectric cable interface making said electrical signals usable by said processor.

15. The piezoelectric security system of claim 12 further comprising a memory device in communication with said processor, said memory device storing reference information for comparison with said electrical signal whereby said intrusion event is classified as being generated by a vehicle, a human being, or an animal.

16. The piezoelectric security system of claim 12 further comprising a memory device in communication with said processor, said memory device storing information about each said intrusion event for later recall.

17. The piezoelectric security system of claim 12 wherein said communication device is a transmitter for broadcasting said alert signal, said piezoelectric security system further comprising:

a receiver in communication with said transmitter, said receiver receiving said alert signal; and an indicator in communication with said receiver, said indicator providing an indication selected from the group consisting of audible indications and visual indications.

18. The piezoelectric security system of claim 12 further comprising:

a wire-loop defining a boundary around a containment area including at least a portion of the selected area;

a containment signal generator in electrical communication with said wire-loop, said containment signal generator producing a containment signal carried by said wire-loop;

a receiver carried by an animal, said receiver responsive to said containment signal;

a processing device in communication with said receiver, said processing device producing a stimulus signal when said containment signal is received; and a stimulus delivery mechanism in communication with said processing device, said stimulus delivery mechanism applying a stimulus to the animal upon receipt of said stimulus signal.

19. A piezoelectric security system for monitoring a selected area defining a first section and a second section, the first section being distinct from said second section, said piezoelectric security system comprising:

a first piezoelectric cable positioned along the first section of the selected area thereby defining a first zone, said first piezoelectric cable producing a first electrical signal in response to mechanical stress transferred to said first cable;

a second piezoelectric cable positioned along the second section of the selected area thereby defining a second zone, said second piezoelectric cable producing a second electrical signal in response to mechanical force transferred to said second cable;

a processor in communication with said first piezoelectric cable and said second piezoelectric cable, said processor responsive to at least one of said first electrical signal and said second electrical signal, said processor detecting an intrusion event when at least one of said first electrical signal and said second electrical signal is received, said processor identifying an intrusion zone based on receipt of at least one of said first electrical signal and said second electrical signal, said processor producing an alert signal in response to said intrusion event, said alert signal containing information including at least said intrusion zone; and a communication device for communicating said alert signal.

20. The piezoelectric security system of claim 19 further comprising a piezoelectric cable interface connected to said plurality of piezoelectric cables and in communication with said processor, said processor receiving said electrical signals through piezoelectric cable interface, said piezoelectric cable interface making said electrical signals usable by said processor.

21. The piezoelectric security system of claim 19 wherein said second piezoelectric cable is positioned along both said first portion and said second portion.

22. The piezoelectric security system of claim 19 wherein said second piezoelectric cable is positioned along both said first section and said second section.

23. The piezoelectric security system of claim 19 wherein said second piezoelectric cable is positioned along a portion the first section and said first piezoelectric cable is positioned along a portion of the second section thereby defining a third zone where said first piezoelectric cable and said second piezoelectric cable overlap.

24. The piezoelectric security system of claim 19 wherein said communication device is an interface adapted to communicate said alert signal to a residential and light commercial security system.

25. The piezoelectric security system of claim 19 wherein said communication device is an indicator providing an indication selected from the group consisting of audible indications and visual indications.

26. The piezoelectric security system of claim 19 wherein said alert signal contains information corresponding to one or more of a time of said intrusion event and a date of said intrusion event.

27. The piezoelectric security system of claim 19 further comprising:

a wire-loop defining a boundary around a containment area including at least a portion of the selected area;

a containment signal generator in electrical communication with said wire-loop, said containment signal generator producing a containment signal carried by said wire-loop;

a receiver carried by an animal, said receiver responsive to said containment signal;

a processing device in communication with said receiver, said processing device producing a stimulus signal when said containment signal is received; and a stimulus delivery mechanism in communication with said processing device, said stimulus delivery mechanism applying a stimulus to the animal upon receipt of said stimulus signal.

28. A piezoelectric security system for monitoring a selected area, said piezoelectric security system comprising:

a plurality of piezoelectric cables positioned along the selected area, each of said plurality of piezoelectric cables has a portion not contiguous with at least one other of said plurality of piezoelectric cables thereby defining a plurality of unique combinations, each of said plurality of unique combinations being a zone, each of said plurality of piezoelectric cables producing an electrical signal in response to a mechanical force;

a processor in communication with said plurality of piezoelectric cables, said processor responsive to each said electrical signal produced by said plurality of piezoelectric cables, said processor detecting an intrusion event when at least one electrical signal is received, said processor identifying said zone based on receipt of a plurality of electric signals corresponding to one of said plurality of unique combinations of piezoelectric cables, said processor producing an alert signal in response to said intrusion event, said alert signal containing information including at least said zone;

an indicator for communicating said alert signal, said indicator providing an indication selected from the group consisting of audible indications and visual indications.

29. The piezoelectric security system of claim 28 further comprising an external interface for communicating said alert signal to an external device.

30. The piezoelectric security system of claim 28 further comprising a calibration unit positioned proximate to said plurality of piezoelectric cables, said calibration unit responsive a calibration request from said processor, said calibration unit generating a mechanical force detectable by said plurality of piezoelectric cables as a calibration signal, said calibration signal being compared to a set of expected results thereby allowing said processor to detect intrusion events.

31. The piezoelectric security system of claim 28 further comprising a memory device in communication with said processor, said memory device storing information about each said intrusion event for later recall.

32. The piezoelectric security system of claim 28 further comprising a memory device in communication with said processor, said memory device storing reference information for comparison with said electrical signal whereby said intrusion event is classified as being generated by a vehicle, a human being, or an animal.

33. The piezoelectric security system of claim 28 further comprising:

a wire-loop defining a boundary around a containment area including at least a portion of the selected area;

a containment signal generator in electrical communication with said wire-loop, said containment signal generator producing a containment signal carried by said wire-loop;

a receiver carried by an animal, said receiver responsive to said containment signal;

a processing device in communication with said receiver, said processing device producing a stimulus signal when said containment signal is received; and a stimulus delivery mechanism in communication with said processing device, said stimulus delivery mechanism applying a stimulus to the animal upon receipt of said stimulus signal.

* * * * *